United States Patent [19]

Nudo

[11] 4,426,057

[45] Jan. 17, 1984

[54] COMBINED SHELF-SUPPORTING BRACKET AND CLOTHES-ROD SUPPORT

[76] Inventor: Alexander S. Nudo, 2508 S. Grand Ave. East, Springfield, Ill. 62707

[21] Appl. No.: 358,517

[22] Filed: Mar. 15, 1982

[51] Int. Cl.[3] ..... A47F 5/00

[52] U.S. Cl. ..... 248/235; 211/123; 211/105.1; 211/90; 248/251; 248/60; 206/289; 224/42.46 A; 108/29

[58] Field of Search ..... 211/113, 134, 105.1, 211/123, 90, 16, 268, 124; 108/29; 248/235, 201, 340, 264, 273, 251, 60; 135/87; 128/94; 272/62; 206/289; 224/42.46 A, 42.46 R, 42.45 R, 42.45 A

[56] References Cited

U.S. PATENT DOCUMENTS

| | | | |
|---|---|---|---|
| D. 189,918 | 3/1961 | Nordenson | 248/251 X |
| D. 257,420 | 10/1980 | Follows | 108/29 X |
| 1,175,802 | 3/1916 | Orcutt | 248/300 |
| 1,891,906 | 12/1932 | Benn | 248/340 |
| 2,432,724 | 12/1947 | Cohen et al. | 248/251 |
| 2,528,358 | 10/1950 | Gross | 248/251 |
| 3,556,306 | 1/1971 | Shell | 211/90 |
| 3,563,182 | 2/1971 | MacFarlane | 108/29 |
| 3,865,336 | 2/1975 | Robertson | 211/123 X |

*Primary Examiner*—Ramon S. Britts
*Assistant Examiner*—Sarah A. Lechok
*Attorney, Agent, or Firm*—Ralph F. Staubly

[57] ABSTRACT

A combined shelf-support and easily detachable support for a clothes-hanger rod comprises a pair of angle-bar sections. The vertically depending wall-anchorable web of each angle-bar has a pair of struck-out tongues. A pair of flexible woven strips have their ends doubled-back and stitched to form loops snugly removably engageable over the tongues to define cradle-like supports for the ends of a clothes-hanger rod.

5 Claims, 4 Drawing Figures

COMBINED SHELF-SUPPORTING BRACKET AND CLOTHES-ROD SUPPORT

BACKGROUND AND OBJECT OF THE INVENTION

It is known to add to a shelf-supporting angle-bar a permanently installed depending rigid cup-shaped bracket for supporting a horizontal rod for holding clothes hangers (U.S. Pat. No. 3,865,336 to Robertson). But there is not known an angle-bar shelf-support having a wall-attachable depending web and being combined with a clothes-rod support comprising a depending sling-like flexible strap easily detachably connected at its upper ends to fingers struck-out from said depending web. It is the object of this invention to produce such a novel combination of elements.

BRIEF DESCRIPTION OF THE DRAWING FIGURES

DETAILED DESCRIPTION

Figure 1:
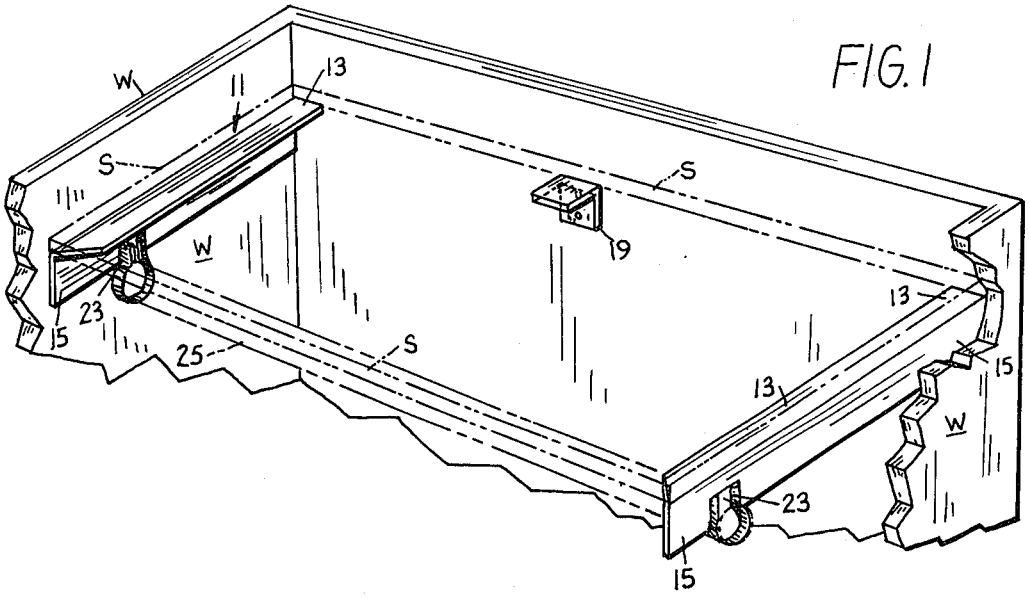
FIG. 1 is a perspective view of a preferred embodiment of the invention.
Figure 2:
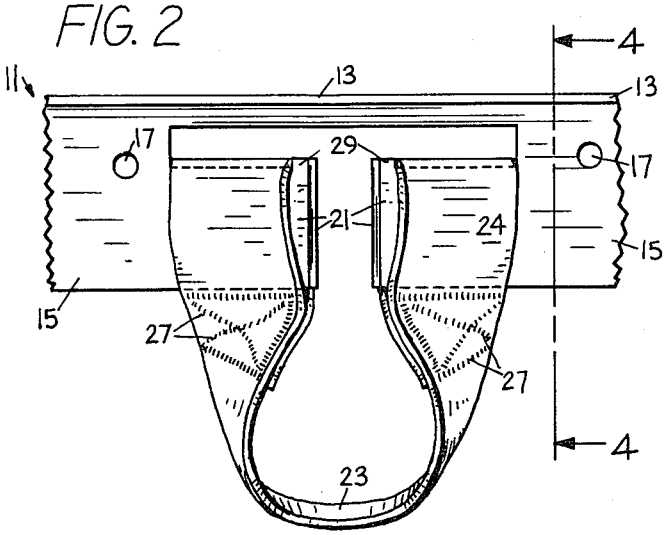
FIG. 2 is an enlarged fragmentary front elevational view of the left clothes-rod installation of FIG. 1.
Figure 4:
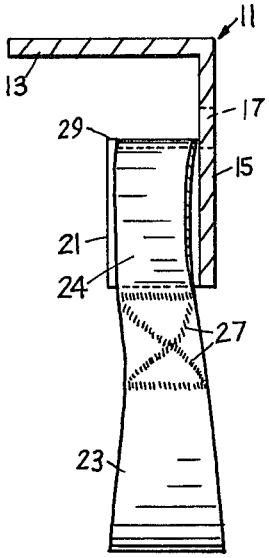
FIG. 4 is an end elevational view of the showing of FIG. 2 in section taken on the line 4—4 of FIG. 2.
Figure 3:
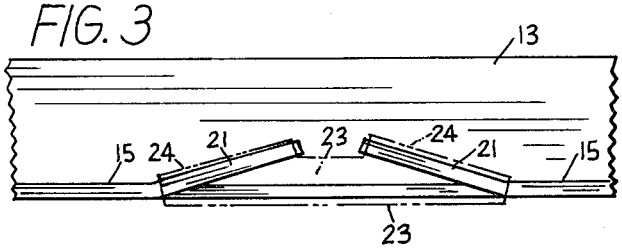
FIG. 3 is a bottom plan view of the disclosure of FIG. 2 with the rod support shown in phantom.

With reference now to the drawing, the numeral 11 designates a section of right-angle angle-bar having a horizontal web 13 for supporting an end edge of a shelf panel S, and having a vertical web 15 for attachment to a wall W of a clothes closet, by nails or screws (not shown) passing through holes 17 (FIG. 2). Optionally, one or more angle brackets 19 can be employed to support the shelf panel S against sagging.

Toward the front end of the each angle-bar web 15, a pair of tongues 21 are struck-out to serve as supports for the ends of depending sling-like flexible straps 23, which form pockets for receiving the ends of a conventional rod 25 for supporting conventional clothes hangers (not shown).

The ends of the straps 23 are doubled-back and stitched at 27 to form loops 24 that snugly slip over the tongues 21 and which are secured thereon by small upright tabs 29 formed on the tongues 21.

Either or both end(s) of the angle-bar sections 11 can be cut off to fit smaller closet spaces.

The invention having been described, what is claimed is:

1. A combined shelf-supporting bracket and support for a clothes-hanger rod, comprising: a section of rigid right-angled angle-bar having a horizontal shelf-supporting web and a depending vertical wall-attachable web, said vertical web having a pair of struck-out tongues, and a sling-like member having opposed ends with recess means therein, said ends being slidably engageable over said tongues for being readily removed therefrom, said sling-like member being sized to form a cradle-like support for the end of a horizontal rod for supporting clothes hangers.

2. The invention according to claim 1 wherein said sling-like member is a flexible woven-cloth strip the ends of which are doubled-back and fastened to define said recess means in the forms of loops engageable over said tongues.

3. The invention according to claim 2 wherein said doubled-back strip ends are fastened by stitching.

4. The invention according to claim 2 wherein the upper outer end of each tongue has an integral upstanding loop-retaining tab thereon.

5. The invention according to claim 1 wherein said angle-bar section has excess-length material at each end, whereby said cradle-like support can be positioned as desired by cutting-off excess material at either or both ends.

* * * * *